US008381313B2

(12) United States Patent
Logan

(10) Patent No.: US 8,381,313 B2
(45) Date of Patent: Feb. 26, 2013

(54) FINGER GUARD SYSTEM

(76) Inventor: Samuel C. Logan, Sarasota, FL (US)

( * ) Notice: Subject to any disclaimer, the term of this patent is extended or adjusted under 35 U.S.C. 154(b) by 287 days.

(21) Appl. No.: 12/813,546

(22) Filed: Jun. 11, 2010

(65) Prior Publication Data

US 2011/0302684 A1 Dec. 15, 2011

(51) Int. Cl.
*A41D 13/08* (2006.01)

(52) U.S. Cl. ..... 2/21

(58) Field of Classification Search ..... 2/21, 20, 2/17, 60, 163; D29/114, 113; 128/880; 602/22; 132/285, 319, 73; 223/101
See application file for complete search history.

(56) References Cited

U.S. PATENT DOCUMENTS

| | | | | | |
|---|---|---|---|---|---|
| 129,392 | A | | 7/1872 | Budington | |
| 203,978 | A | * | 5/1878 | Woods | 47/1.01 R |
| 471,221 | A | * | 3/1892 | Moores | 294/25 |
| 617,929 | A | | 1/1899 | Fowble | |
| 622,386 | A | * | 4/1899 | Peery | 606/160 |
| 955,879 | A | * | 4/1910 | Jackson | 34/89.2 |
| RE14,171 | E | * | 7/1916 | Hicks | 68/220 |
| 1,267,233 | A | * | 5/1918 | Lafferty | 30/123 |
| 1,337,957 | A | * | 4/1920 | Rasmussen | 2/21 |
| 1,388,618 | A | * | 8/1921 | Stein et al. | 2/21 |
| 1,919,084 | A | * | 7/1933 | Wyant | 2/20 |
| 2,250,766 | A | * | 7/1941 | Jorgenson | 2/21 |
| 2,323,854 | A | * | 7/1943 | Silverman | 2/21 |
| 2,409,101 | A | | 10/1946 | Brittingham | |
| 2,460,155 | A | * | 1/1949 | Talarico | 2/21 |
| 2,467,613 | A | | 4/1949 | Davis | |
| 2,487,101 | A | * | 11/1949 | Colby et al. | 2/21 |
| 2,538,889 | A | * | 1/1951 | Swarin | 2/21 |
| D239,143 | S | * | 3/1976 | Arluck et al. | D24/190 |
| D314,727 | S | | 2/1991 | Samaras | |
| 5,063,613 | A | * | 11/1991 | Brown | 2/21 |
| D335,196 | S | * | 4/1993 | Lamb et al. | D29/120.1 |
| D351,257 | S | | 10/1994 | Roberts et al. | |
| 5,450,626 | A | | 9/1995 | Sorrels | |
| D373,225 | S | | 8/1996 | Theroux et al. | |
| D373,656 | S | | 9/1996 | Sorrels | |
| D389,282 | S | | 1/1998 | Dyke et al. | |
| D414,300 | S | * | 9/1999 | Silvey | D29/114 |
| D418,258 | S | | 12/1999 | Moro | |
| D465,306 | S | | 11/2002 | Price | |
| 6,729,510 | B1 | * | 5/2004 | Romanov | 223/101 |
| 6,807,681 | B2 | * | 10/2004 | Sorrels | 2/21 |
| D545,503 | S | | 6/2007 | Ryscavage | |
| 7,296,300 | B2 | * | 11/2007 | Votolato | 2/21 |

(Continued)

*Primary Examiner* — Amy Vanatta
(74) *Attorney, Agent, or Firm* — Mark R. Malek, Esq.; Zies Widerman & Malek

(57) ABSTRACT

A finger guard system may include a finger guard adapted to be worn on a finger of a user, and a thumb guard adapted to be worn on a thumb of the user. The finger guard may include a substantially tubular finger guard main body having a top, a bottom, an upper portion, a lower portion, and a medial portion including a bend so that the upper portion is angled with respect to the lower portion. The finger guard may also include a longitudinal slit that extends along the bottom of the finger guard main body from the upper portion thereof to the lower portion thereof. The thumb guard has a substantially tubular thumb guard main body having a top, a bottom, an upper portion, a lower portion, and a medial portion that includes a bend so that the upper portion is angled with respect to the lower portion. A longitudinal slit may formed through the thumb guard main body on the bottom and extending the entire length of the bottom.

19 Claims, 15 Drawing Sheets

U.S. PATENT DOCUMENTS

D577,155 S * 9/2008 Hauser ..... D29/114
D640,835 S * 6/2011 Logan ..... D29/114
D651,357 S * 12/2011 Logan ..... D29/114
D657,094 S * 4/2012 Logan ..... D29/114
2003/0056274 A1* 3/2003 Sorrels ..... 2/21

* cited by examiner

FINGER GUARD SYSTEM

FIELD OF THE INVENTION

The present invention relates to kitchen utensils and, more particularly, to the field of guards to be worn on fingers of a user to protect the user's fingers while cooking.

BACKGROUND OF THE INVENTION

There is a recognized need to protect one's fingers when engaging in various activities that involve the use of sharp objects. For example, when cooking, one may use sharp knives during chopping operations. Of course, one's fingers are generally in the general vicinity of the chopping action that occurs when using sharp knives. More experienced chefs may have mastered their knife skills to the point where accidentally cutting their fingers normally does not occur. Others, however, who may not be as experienced as chefs, may not possess similar mastery and, as such, may desire a protective covering to be worn on their fingers and thumb.

One type of finger guard is disclosed in U.S. Pat. No. 5,450,626 to Sorrels, which discloses a pair of finger guards to be worn on the thumb and forefinger of a dentist. The finger guards disclosed in the Sorrels '626 patent are identical for both the forefinger and the thumb. The Sorrels '626 finger guards, however, do not provide flexibility that may be necessary in the cooking application.

U.S. Design Pat. No. D465,306 to Price discloses a thumb protection device. The device disclosed by the Price '306 patent includes a flat front and rear portion and a tubular body that extends towards the bottom portion adjacent the medial portion thereof. Similar to the Sorrels '626 patent, however, the Price '306 patent does not provide for flexibility. U.S. Design Pat. No. D545,503 to Ryscavage discloses a design for a finger pad that has a flat rear portion and a rounded tip to be worn adjacent the end of the user's finger. The Ryscavage '503 design, however, allows for a great deal of open space adjacent the user's fingers. Unfortunately, such a design does not provide for adequate protection of the user's fingers.

SUMMARY OF THE INVENTION

With the foregoing in mind, it is therefore and object of the present invention to provide a finger guard system that includes a finger guard and a thumb guard that allow users to readily protect their fingers and thumbs while advantageously providing flexibility. It is also an object of the present invention to provide a finger guard system that is light in weight and that does not interfere with a user's motion.

These and other objects, features and advantages according to the present invention are provided by a finger guard system comprising a finger guard and a thumb guard. The finger guard may be adapted to be worn on a finger of a user and may include a substantially tubular finger guard main body having a top, a bottom, an upper portion, a lower portion opposite the upper portion, and a medial portion between the upper portion and the lower portion. The medial portion may include a bend so that the upper portion is angled with respect to the lower portion.

The finger guard may include a longitudinal slit formed through the bottom that extends from the upper portion of the finger guard main body through to the lower portion of the finger guard main body. The upper portion of the finger guard main body may include an angled edge, and the lower portion of the finger guard main body may include an angled edge.

The thumb guard may be adapted to be worn on a thumb of a user, and may include a substantially tubular thumb guard main body having a top, a bottom, an upper portion, a lower portion opposite the upper portion, and a medial portion, the medial portion including a bend so that the upper portion is angled with respect to the lower portion. The thumb guard may include a longitudinal slit formed through the thumb guard main body on the bottom and extending the entire length of the bottom of the thumb guard main body.

The bottom of the finger guard main body may be adapted to be positioned adjacent a tip of the user's finger when worn by the user. The bottom of the finger guard main body may extend between the angled edge of the upper portion of the finger guard main body to the lower portion of the finger guard main body.

The bottom of the thumb guard main body may be adapted to be positioned adjacent a tip of the user's thumb when worn by the user. The bottom of the thumb guard main body may extend between the edge of the upper portion of the thumb guard main body to the medial portion of the thumb guard main body. The bottom of the thumb guard main body may have an open tubular shape extending from the upper portion of the thumb guard main body to the medial portion of the thumb guard main body.

The thumb guard and the finger guard may be worn by the user at the same time. The finger guard may be positioned over any finger of the user excluding the user's thumb. Each of the finger guard and the thumb guard may be made of a semi-rigid material.

The finger guard system may also include a finger shield. The finger shield may be adapted to be worn on a finger of a user to cover a plurality of the user's fingers. The finger shield may comprise a front, a rear, a top, a bottom, and a finger engagement member. The finger engagement member may have a main body portion and a side portion. Further, the finger engagement member may be connected to the rear adjacent a medial portion thereof. The front, the rear, the top, the bottom and the finger engagement member may be integrally formed as a monolithic unit.

DETAILED DESCRIPTION OF THE PREFERRED EMBODIMENT

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime and multiple prime notations refer to similar elements in alternate embodiments.

Figure 1:
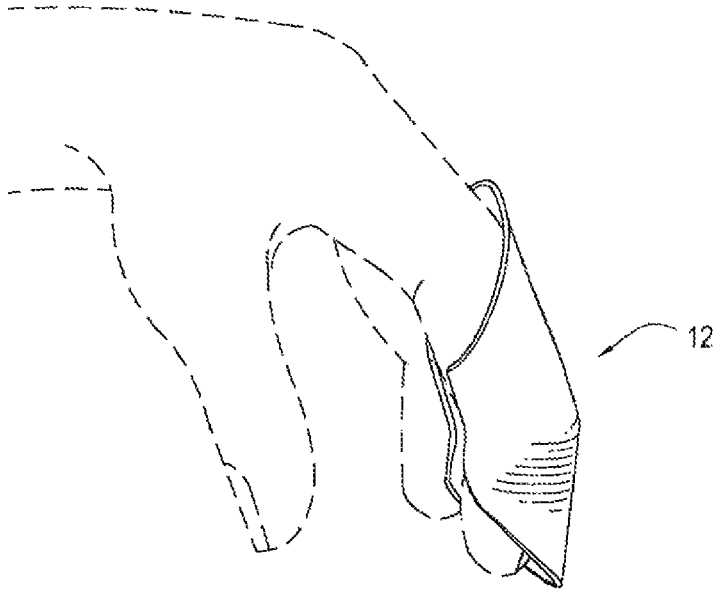
FIG. 1 is an environmental view of a finger guard of a finger guard system according to the present invention being positioned on the forefinger of a user.
Figure 2:
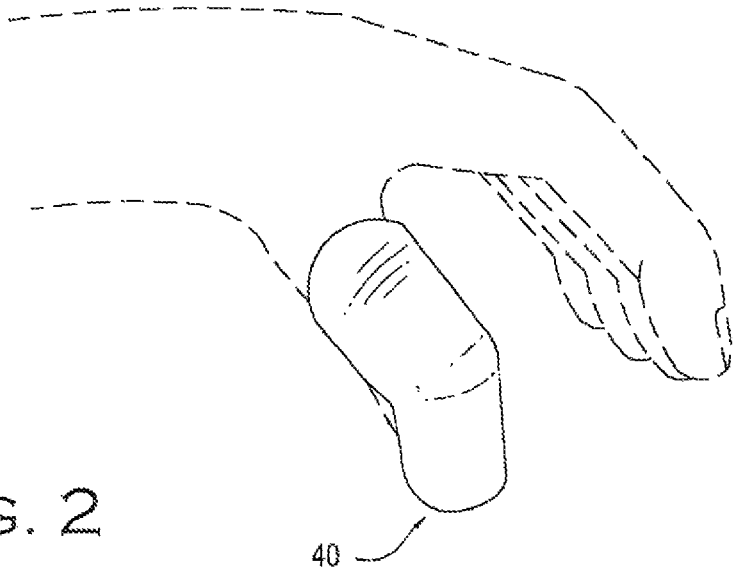
FIG. 2 is an environmental view of a thumb guard of a finger guard system according to the present invention positioned on the thumb of a user.
Figure 3:
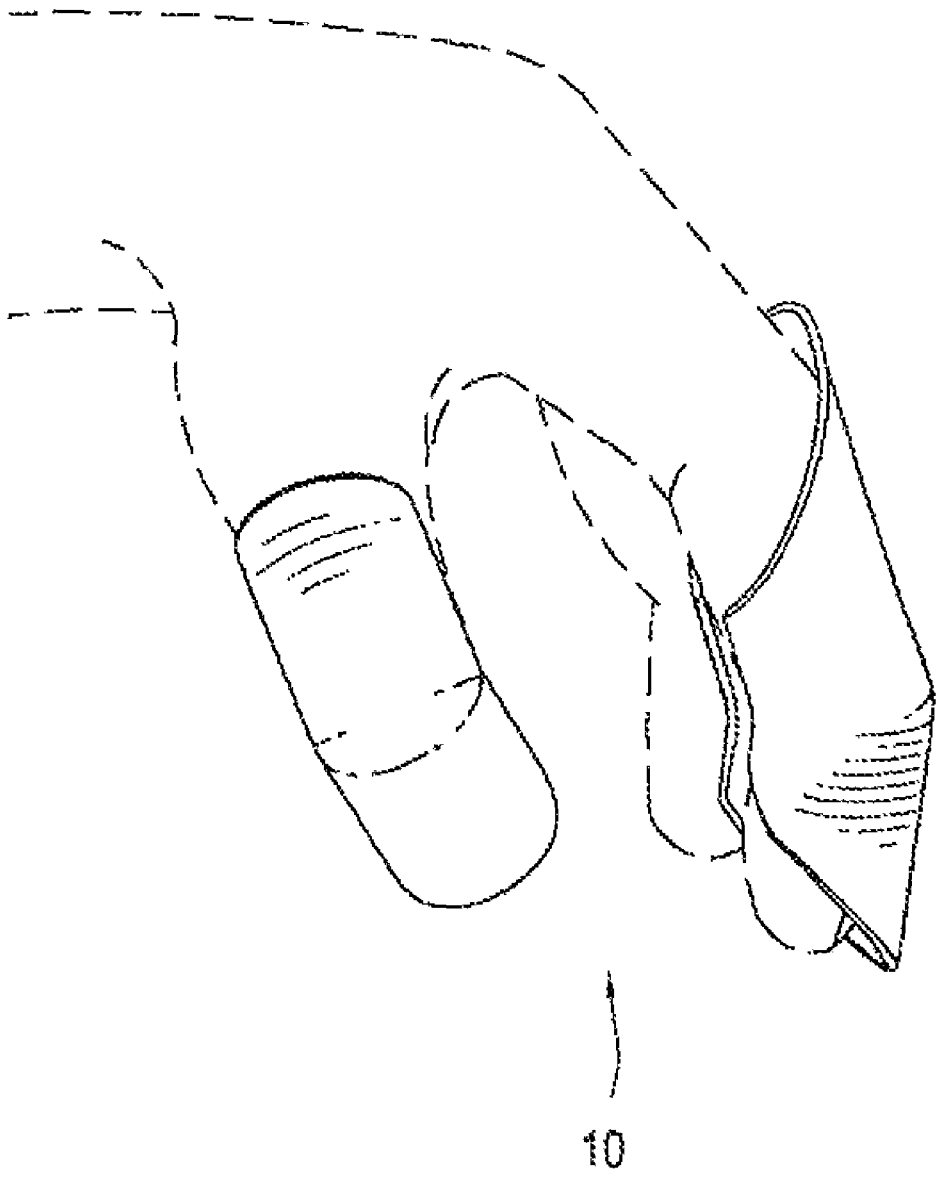
FIG. 3 is an environmental view of a finger guard system according to the present invention showing a thumb guard and a finger guard being worn on the respective thumb and forefinger of a user.
Figure 4:
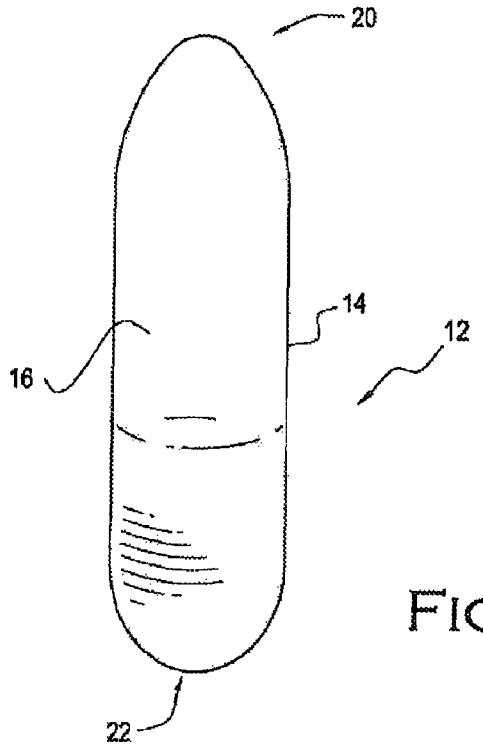
FIG. 4 is a top plan view of the finger guard illustrated in FIG. 1.

Referring initially to FIGS. 1-3, a finger guard system 10 according to the present invention is now described in greater detail. More particularly, the finger guard system 10 is illustrated in FIG. 3 as including a finger guard 12 and a thumb guard 40. As perhaps best illustrated in FIG. 1, the finger guard 12 is adapted to be worn on a finger of the user. Although the finger guard 12 of the finger guard system 10 according to the present invention is illustrated in FIG. 1 as being worn on the forefinger of the user, those skilled in the art will appreciate that the finger guard may be worn on any of the fingers of the user. As perhaps best illustrated in FIG. 2, the thumb guard 40 is adapted to be worn on a thumb of the user.

The finger guard system 10 according to the present invention advantageously allows a user to wear the finger guard 12 and the thumb guard 40 to protect any finger and/or thumb of the user when the user may be engaging sharp objects such as, for example, a knife while cooking. Those skilled in the art, however, will appreciate that the finger guard system 10 according to the present invention is not limited to use while cooking. Several other applications of the finger guard system 10 are contemplated by the present invention. For example, medical professionals may desire to use the finger guard system 10 when using sharp instruments, or when the medical professional's fingers may be within the vicinity of a patient's mouth such as, for example, a dentist or dental hygienist. The present invention also contemplates that the finger guard system 10 may be used in any other application where the user's fingers or thumb are at risk of being cut by sharp objects.

Referring now to FIGS. 4-9, additional features of the finger guard 12 according to the present invention are now described in greater detail. The finger guard 12 illustratively includes a substantially tubular finger guard main body 14. Although the substantially tubular finger guard, main body 14 is illustrated as having a substantially cylindrical shape, those skilled in the art will appreciate that the finger guard main body may have any shape, e.g., polygonal. The finger guard main body 14 includes a top 16, a bottom 18, an upper portion 20, a lower portion 22, and a medial portion 24. More specifically, the lower portion 22 of the finger guard main body 12 is positioned opposite the upper portion 20 of the finger guard main body. Similarly, the top 16 of the finger guard main body 12 is position opposite the bottom 18 of the finger guard main body. The medial portion 24 of the finger guard main body 14 is positioned between the upper portion 20 of the finger guard main body and the lower portion 22 of the finger guard main body.

Figure 6:
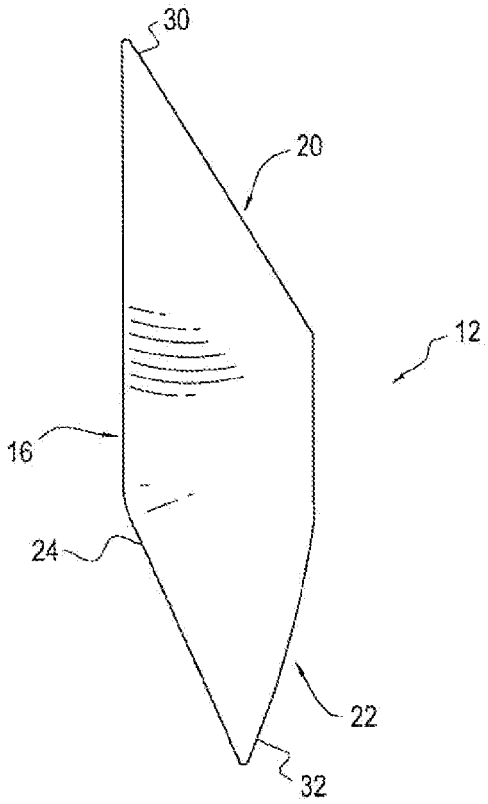
FIG. 6 is a right side elevation view of the finger guard illustrated in FIG. 1.
Figure 7:
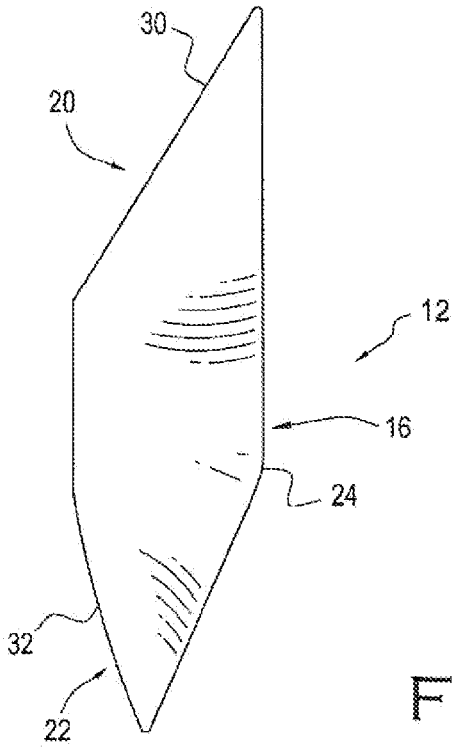
FIG. 7 is a left side elevation view of the finger guard illustrated in FIG. 1.
Figure 8:
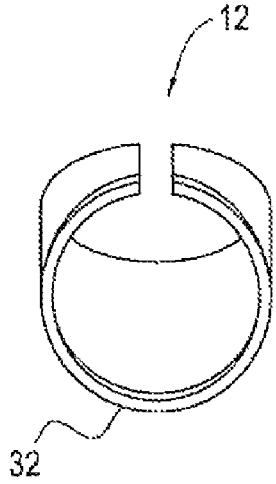
FIG. 8 is a rear view of the finger guard illustrated in FIG. 1.
Figure 9:
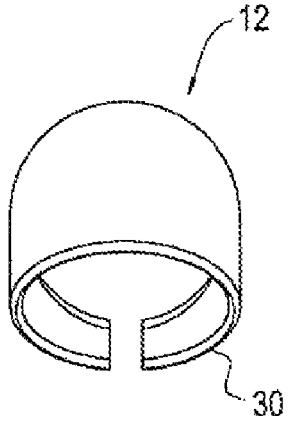
FIG. 9 is a front view of the finger guard illustrated in FIG. 1.
Figure 10:
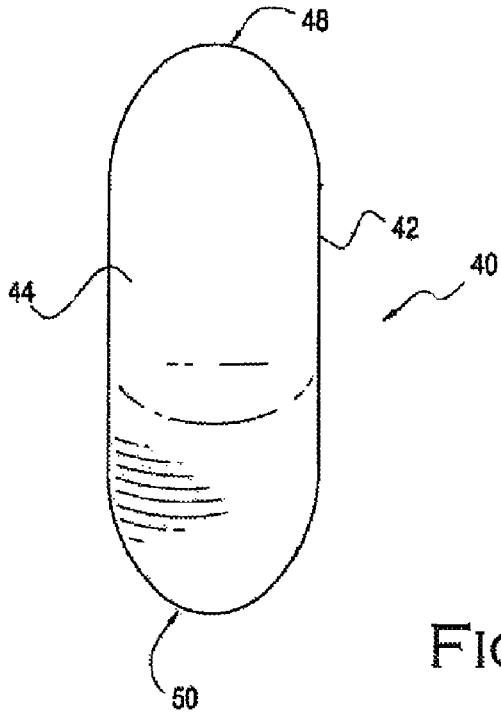
FIG. 10 is a top plan view of the thumb guard illustrated in FIG. 2.

As perhaps best illustrated in FIGS. 6 and 7, the medial portion 24 of the finger guard main body 14 includes a bend so that the upper portion 20 of the finger guard main body is angled with respect to the lower portion 22 of the finger guard main body. Referring back to FIG. 1, the bend in the medial portion 24 of the finger guard main body 14 illustratively allows the finger guard 12 to be readily positioned over the finger of the user so that the bend in the medial portion of the finger guard main body may be positioned adjacent the knuckle of the user's finger. Accordingly, the bend in the medial portion 24 of the finger guard main body 14 advantageously allows for the finger guard 12 to be readily worn by the user while simultaneously accounting for the natural the bend in the user's finger. In turn, this advantageously enhances comfort and flexibility when the user is wearing the finger guard 12.

Although not illustrated, it is contemplated that the finger guard 12 according to the present invention may include a lateral slit formed through the finger guard main body 14. More specifically, the lateral slit may be formed slightly above the medial portion 24 of the finger guard main body 14.

The lateral slit positioned adjacent the bend in the medial portion 24 of the finger guard main body 14 may advantageously enhance flexibility of the finger guard 12 when worn on the finger of the user. Enhanced flexibility of the finger guard 12 advantageously allows a user to readily bend his/her fingers when the finger guard is worn. The position of the lateral slit formed through the finger guard main body 14 may be designed so as to provide as much flexibility as possible adjacent the bend in the medial portion 24 of the finger guard main body. The lateral slit is an optional feature of the finger guard 12.

Figure 5:
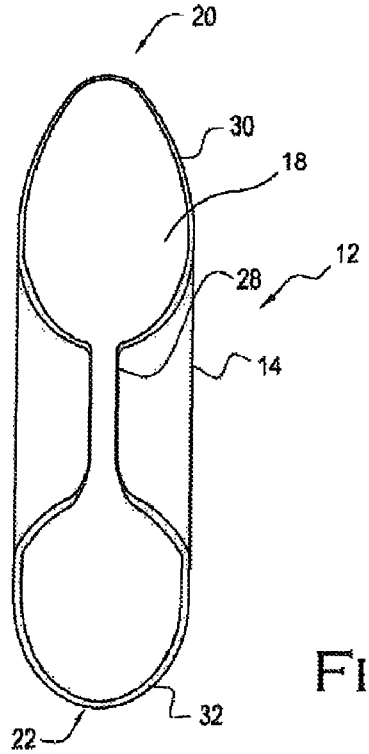
FIG. 5 is a bottom plan view of the finger guard illustrated in FIG. 1.

As also illustrated in FIG. 5, a longitudinal slit 28 may be formed through the finger guard main body 14. The longitudinal slit 28 illustratively extends from the upper portion 20 of the finger guard main body 14 down through the lower portion 22 of the finger guard main body along the bottom 18 of the finger guard main body. The longitudinal slit 28 formed through the finger main body 14 advantageously allows for users having different sized fingers to readily use the finger guard 12 of the finger guard system 10 according to the present invention. The positioning of the longitudinal slit 28 formed through the finger guard main body 14 provides the advantage of a finger guard 12 that may be worn by users having different sized fingers while simultaneously providing a finger guard having enhanced flexibility to allow the user to readily use the finger guard without any significant limitation to motion. This is especially true when the optional lateral slit is provided in the finger guard main body 14.

Referring now additionally to FIGS. 6 and 7, additional features of the finger guard 12 of the finger guard system 10 according to the present invention are now described in greater detail. More particularly, the upper portion 20 and the lower portion 22 of the finger guard main body 14 include angled edges. The lower portion 22 of the finger guard main body, when viewed in the elevation views illustrated in FIGS. 6 and 7, include an angled edge 32 that ends at a point. Accordingly, when the finger guard 12 of the finger guard system 10 according to the present invention is worn by the user, as illustrated, for example, in FIG. 1, the lower most portion of the lower portion 22 of the finger guard main body 14 is adapted to cover the fingertips of the user. Further, the angled edge 32 of the lower portion 22 of the finger guard main body 14 angles upwardly so that the fingertips of the user may advantageously contact the surface upon which a cutting activity may be occurring to provide the user with the ability to use his/her fingertip to feel the surface, thereby enhancing use of the finger guard system 10. Similarly, the angled upper edge 32 of the upper portion 20 of the finger guard main body 14 terminates in a point, as illustrated in the elevation views of FIGS. 6 and 7. This advantageously allows for more of the user's fingers to be covered when the finger guard 12 is being worn by the user.

As perhaps best illustrated in FIG. 5, the bottom 18 of the finger guard main body 14 extends between the angled edge of the upper portion 20 of the finger guard main body to the angled edge of the lower portion 22 of the finger guard main body. The bottom 18 of the finger guard main body 14 has an open tubular shape extending from the lower portion 22 of the finger guard main body to the upper portion 20 of the finger guard main body. The open tubular shape of the finger guard main body 14 is formed by the longitudinal slit 28 formed through the finger guard main body.

Referring now to FIGS. 10-15, the thumb guard 40 of the finger guard system 10 according to the present invention is now described in greater detail. The thumb guard 40 is adapted to be worn on the thumb of the user as illustrated, for example, in FIG. 2. More specifically, when the thumb guard 40 is worn by the user, an exterior surface of the thumb guard is adapted to be positioned over an exterior portion of the user's thumb so that the user's thumb may be protected from injury that may occur when handling sharp objects, or when engaging in activities that may cause such injuries to the user's thumb.

The thumb guard 40 of the finger guard system 10 according to the present invention may include a substantially tubular thumb guard main body 42. The substantially tubular shape of the thumb guard main body 44 is illustrated as being cylindrical. Those skilled in the art, however, will appreciate that the thumb guard main body 42 may have any tubular shape, e.g., polygonal. The thumb guard main body 42 may include a top 44, a bottom 46, an upper portion 48, a lower portion 50, and a medial portion 52. More specifically, the top 44 of the thumb guard main body 42 may be positioned opposite the bottom 46 of the thumb guard main body. Similarly, the upper portion 48 of the thumb guard main body 42 may be positioned opposite the lower portion 50 of the thumb guard main body. The medial portion 52 of the thumb guard main body 42 may be positioned between the upper portion 48 of the thumb guard main body and the lower portion 50 of the thumb guard main body.

Figure 12:
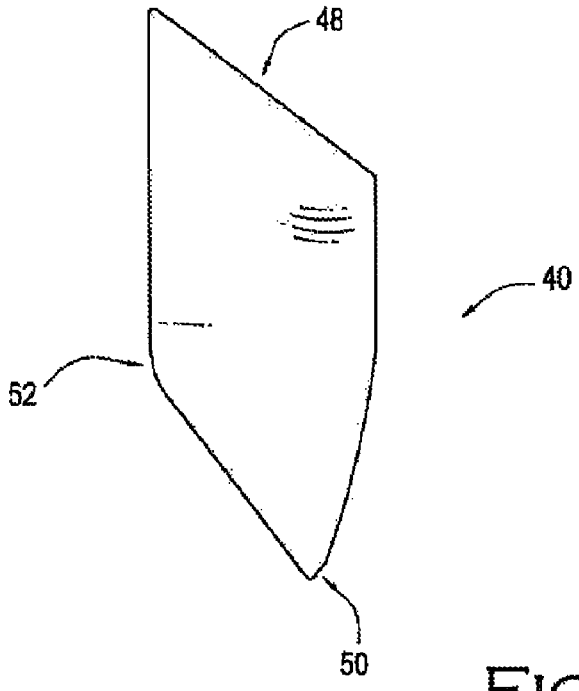
FIG. 12 is a right side elevation view of the thumb guard illustrated in FIG. 2.
Figure 13:
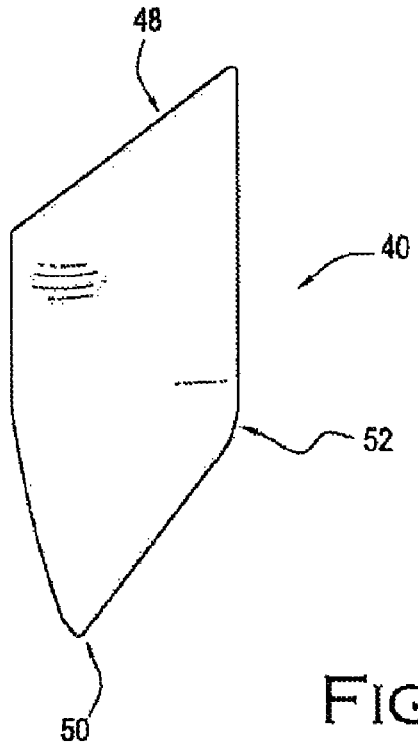
FIG. 13 is a left side elevation view of the thumb guard illustrated in FIG. 2.
Figure 14:
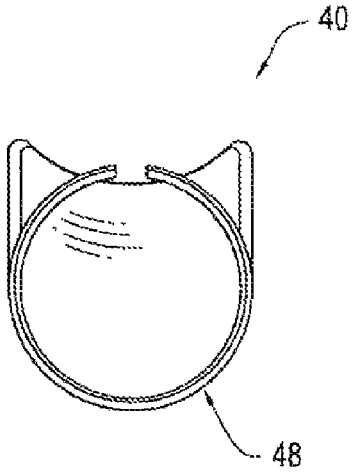
FIG. 14 is a rear view of the thumb guard illustrated in FIG. 2.
Figure 15:
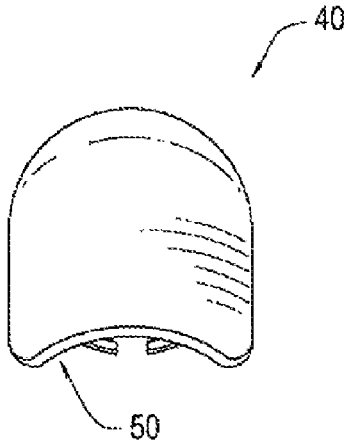
FIG. 15 is a front view of the thumb guard illustrated in FIG. 2.
Figure 16:
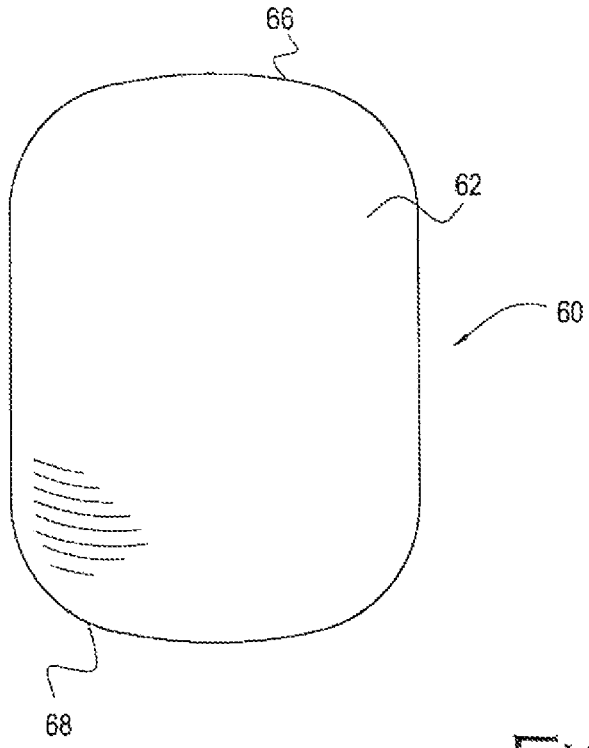
FIG. 16 is a front elevation view of an ambidextrous finger shield to be worn over fingers of a user according to the present invention.
Figure 17:
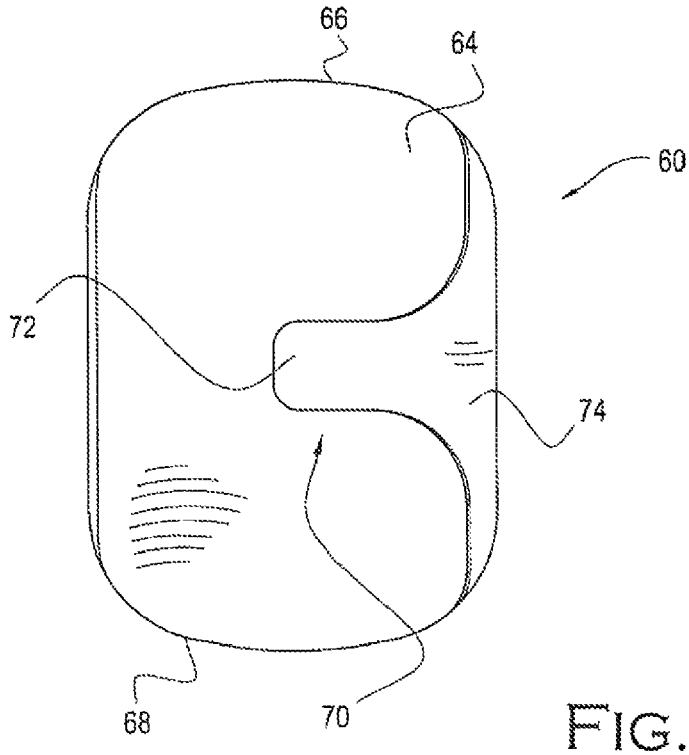
FIG. 17 is a rear elevation view of an ambidextrous finger shield to be worn over fingers of a user according to the present invention.
Figure 18:
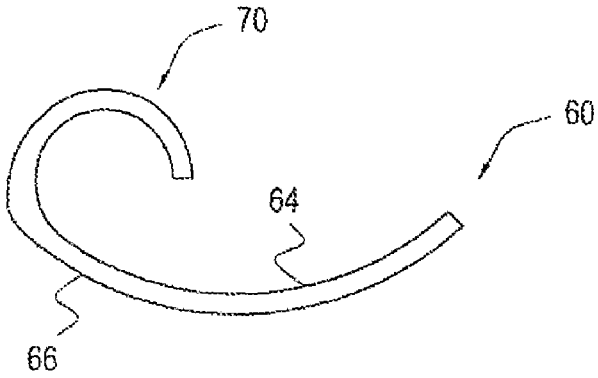
FIG. 18 is a top plan view of an ambidextrous finger shield to be worn over fingers of a user according to the present invention.
Figure 19:
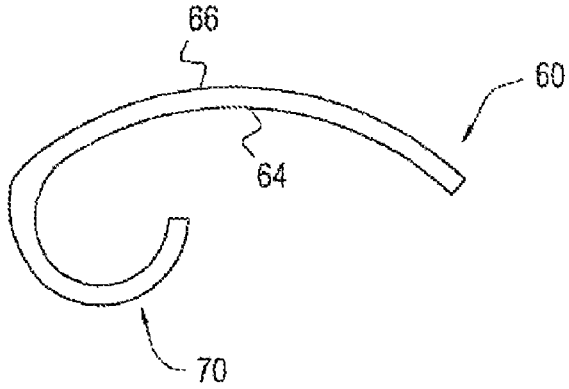
FIG. 19 is a bottom plan view of an ambidextrous finger shield to be worn over fingers of a user according to the present invention.
Figure 20:
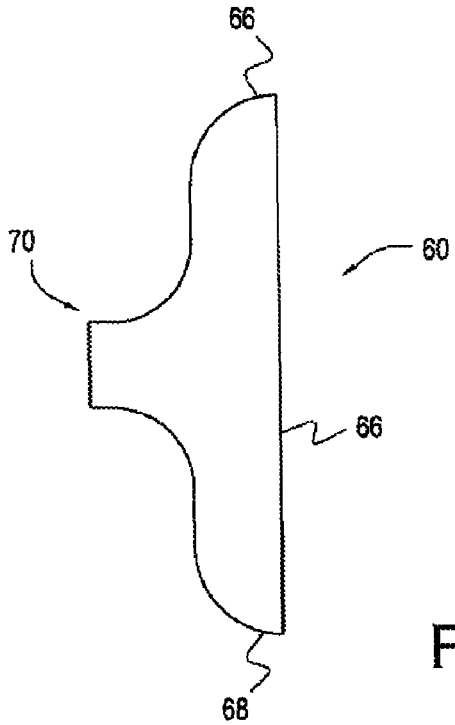
FIG. 20 is a left side elevation view of an ambidextrous finger shield to be worn over fingers of a user according to the present invention.
Figure 21:
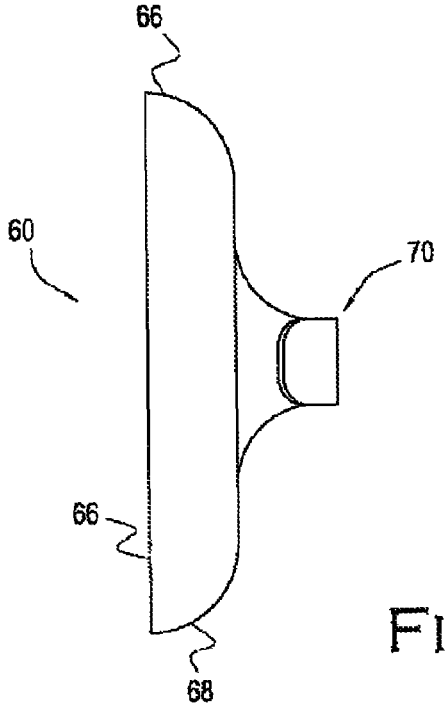
FIG. 21 is a right side elevation view of an ambidextrous finger shield to be worn over fingers of a user according to the present invention.

As perhaps best illustrated in FIGS. 12 and 13, the medial portion 52 of the thumb guard main body 42 may include a bend so that the upper portion 48 of the thumb guard main body is angled with respect to the lower portion 50 of the thumb guard main body. Referring back to FIG. 2, the bend in the medial portion 52 of the thumb guard main body 42 illustratively allows the thumb guard 40 to be readily positioned over the thumb of the user so that the bend in the medial portion of the thumb guard main body may be positioned adjacent the knuckle of the thumb of the user. Accordingly, the bend in the medial portion 52 of the thumb guard main body 42 advantageously allows for the thumb guard 40 to be readily worn by the user while simultaneously accounting for the natural bend in the user's thumb. In turn, this advantageously enhances comfort and flexibility when the user is wearing the thumb guard 40.

Figure 11:
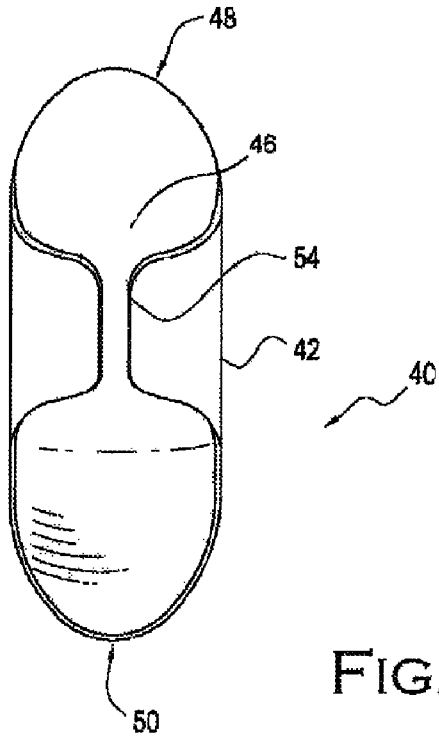
FIG. 11 is a bottom plan view of the thumb guard illustrated in FIG. 2.

As perhaps best illustrated in FIG. 11, a longitudinal slit 54 may be formed through the thumb guard main body 42. More specifically, the longitudinal slit 54 is preferably formed through the thumb guard main body 42 on the bottom 46 of the thumb guard main body, and extends the entire length of the bottom of the thumb guard main body. The longitudinal slit 54 formed through the thumb guard main body 42 advantageously allows for users having different sized thumbs to readily use the thumb guard 40 of the finger guard system 10 according to the present invention. The positioning of the longitudinal slit 54 formed through the thumb guard main body 42 provides the combined advantage of allowing users having different sized fingers to comfortably wear the thumb guard 40 according to the present invention, while simultaneously accounting for the natural bend that occurs in the user's thumb so that the user maintains flexibility when using the thumb guard.

As perhaps best illustrated in FIG. 11, the bottom 46 of the thumb guard main body 42 is adapted to be positioned adjacent a tip of the user's thumb when worn by the user. This advantageously allows for the user's thumb to be protected by an exterior portion of the thumb guard main body 42 while simultaneously allowing the tip of the thumb of the user to advantageously contact the surface upon which the cutting activity may be occurring to provide the user with the ability to use the tip of his/her thumb to feel the surface, thereby enhancing use of the finger guard system 10.

The bottom 46 of the thumb guard main body 42 illustratively extends between an edge of the upper portion 48 of the thumb guard main body to the medial portion 52 of the thumb guard main body. Further, the bottom 46 of the thumb guard main body 42 illustratively includes an open tubular shape extending from the upper portion 48 of the thumb guard main body to the lower portion 50 of the thumb guard main body. The open tubular shape of the thumb guard main body 42 is formed by the longitudinal slit 54 formed through the thumb guard main body.

Referring now additionally to FIG. 16-23, a finger shield 60 of the finger guard system 10 according to the present invention is now described in greater detail. The finger shield 60 illustratively includes a front 62, a rear 64, a top 66, and a bottom 68. The finger shield 60 is illustrated as having curved edges, but those skilled in the art will appreciate that the finger shield according to the present invention may have any shape. The finger shield 60 is adapted to be worn by a user to protect more than one finger when engaging in activities that may cause injury to the user's fingers.

The finger shield 60 includes a finger engagement member 70. The finger engagement member 70 includes a main body portion 72, and a side portion 74. The side portion 74 of the finger engagement member 70 connects to a side portion of the finger shield 60. More specifically, the front 62, rear 64, top 66, bottom 68, and the finger engagement member 70 are integrally formed as a monolithic unit to form the finger shield 60.

The side portion 74 of the finger engagement member and the main body portion 72 of the finger engagement member are similarly integrally formed as a monolithic unit. At the point where the side portion 74 of the finger engagement member 70 meets the side portion of the finger shield 60, a pocket area may be formed to so that the user's fingers engage portions of the pocket when the finger shield 60 is worn by the user. As perhaps best illustrated in FIGS. 18 and 19, the main body portion 72 of the finger engagement member 70 may be curved to engage the finger of the user. The curvature of the finger engagement member 70 may be any radius of curvature. For example, the curvature of the finger engagement member 70 may be provided with the end of the main body 72 being spaced apart from the rear 64 of the finger shield 60, as illustrated, for example, in FIGS. 18 and 19. The end of the main body 72 of the finger engagement member 70 may also be so curved as to contact the rear 64 of the finger shield 60.

Figure 22:
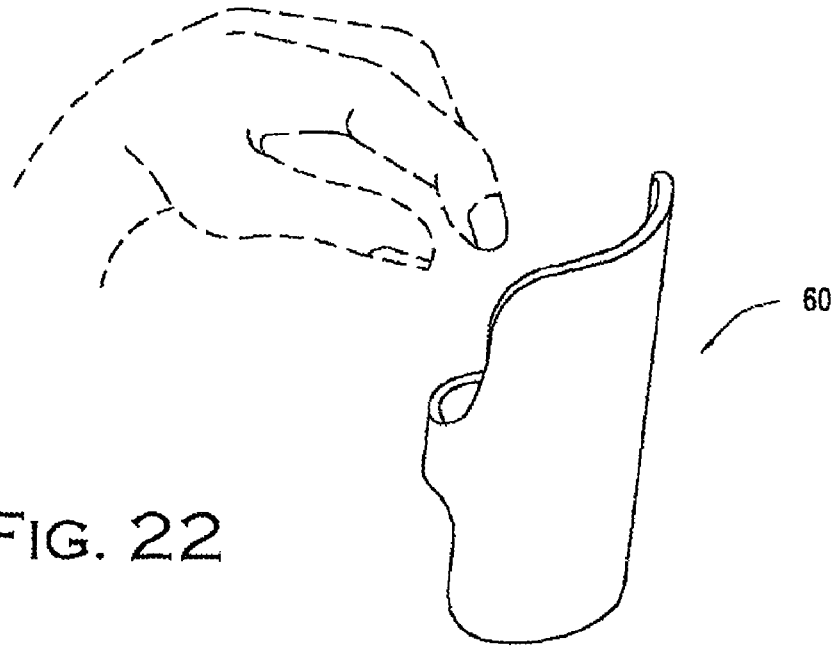
FIG. 22 is an environmental view of an ambidextrous finger shield to be worn over fingers of a user showing engagement between the fingers of a user's left hand and the ambidextrous finger shield according to the present invention.
Figure 23:
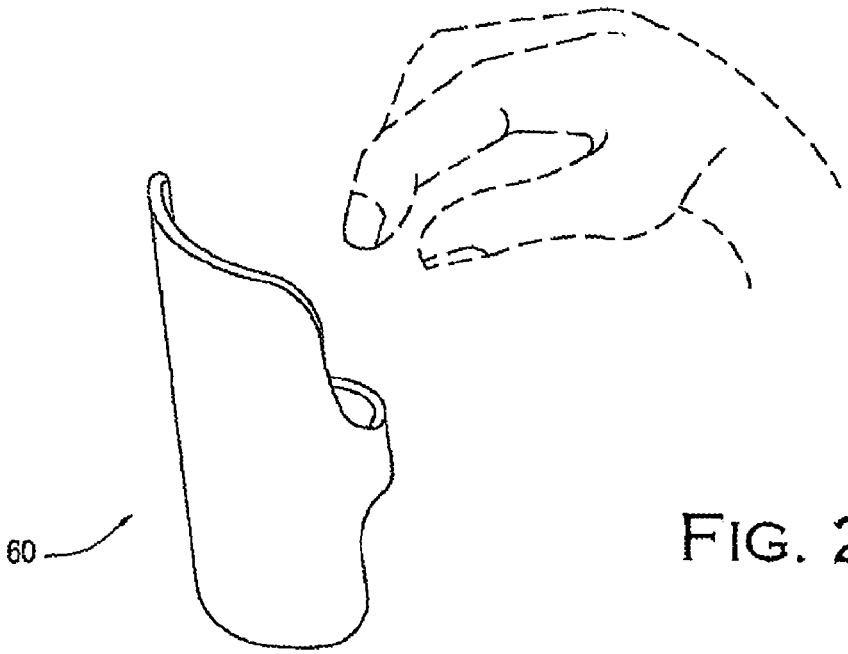
FIG. 23 is an environmental view of an ambidextrous finger shield to be worn over fingers of a user showing engagement between the fingers of a user's right hand and the ambidextrous finger shield according to the present invention.

FIGS. 22 and 23 illustrate the finger shield 60 engaging either a left hand or a right hand of the user. Although it is illustrated that two of the user's fingers may engage the finger engagement member 70 of the finger shield 60, those skilled in the art will appreciate that the finger shield 60 is adapted to be worn by the user by engaging any number of fingers with the finger engagement member. Accordingly, the finger shield 60 according to the present invention contemplates that the user may engage one finger with the finger engagement member 70 to position the finger shield in a manner so that more than one of the user's fingers are covered by the finger shield. Accordingly, the finger shield 60 according to the present invention advantageously provides the user enhanced flexibility by leaving certain fingers free to be moved while only one finger is necessary to engage the finger engagement member 70 to secure the finger shield to the user's fingers.

Figure 24:
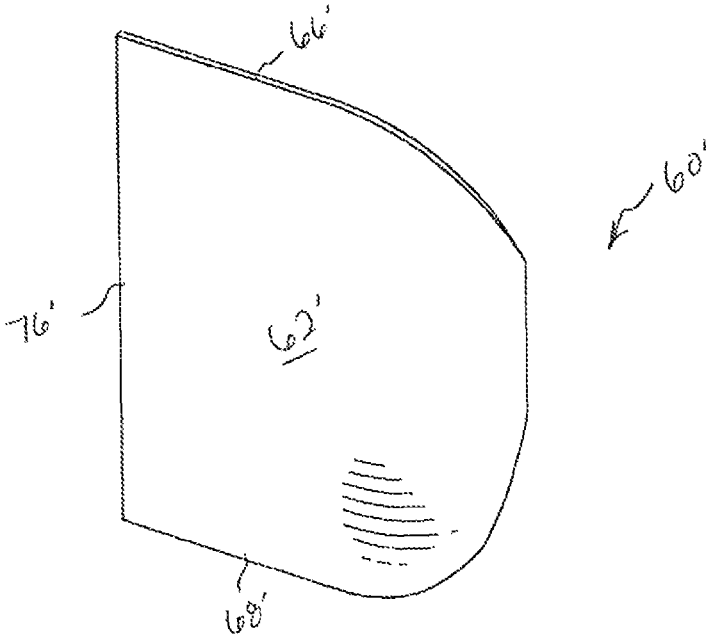
FIG. 24 is a front perspective view of an embodiment of an ambidextrous finger shield to be worn over fingers of a user according to the present invention.
Figure 25:
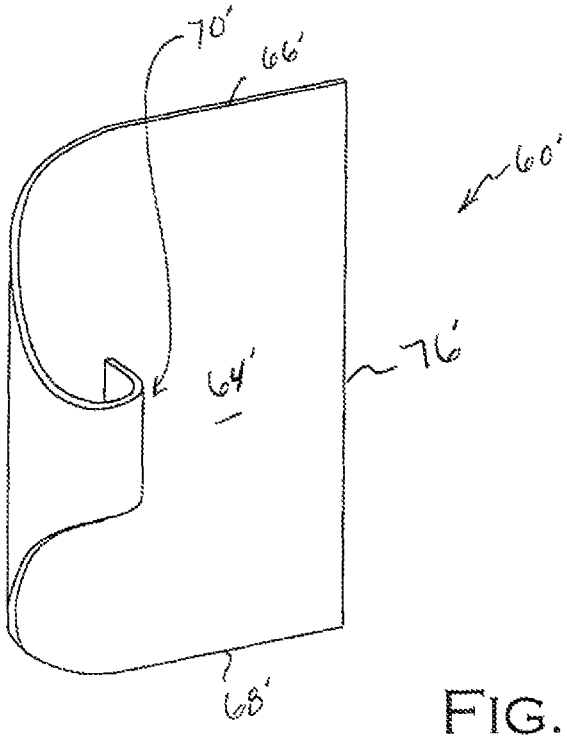
FIG. 25 is a rear perspective view of the ambidextrous finger shield illustrated in FIG. 24.

Referring now additionally to FIGS. 24 and 25, another embodiment of the finger shield 60' according to the present invention is now described in greater detail. In this embodiment of the finger shield 60', an outer peripheral side portion of the finger shield is curved adjacent the finger engagement member 70'. The peripheral side portion of the finger shield 60' opposite the curved side portion, however, is provided by a substantially straight edge 76'. The substantially straight edge 76' of the finger shield 60' advantageously allows the finger shield to be used in a manner similar to a spatula. In other words, the user may disengage the finger shield 60' from their finger, turn the finger shield over, and use the straight edge 76' of the finger shield to closely engage a cooking surface to pick up items from the cooking surface, much like a scraping or scooping motion made with a spatula. This advantageously provides additional functionality to the finger shield 60' according to the present invention. The remaining elements of this embodiment of the finger shield 60' are similar to those of the first embodiment of the finger shield 60, are labeled with prime notation, and require no further discussion herein.

Figure 26:
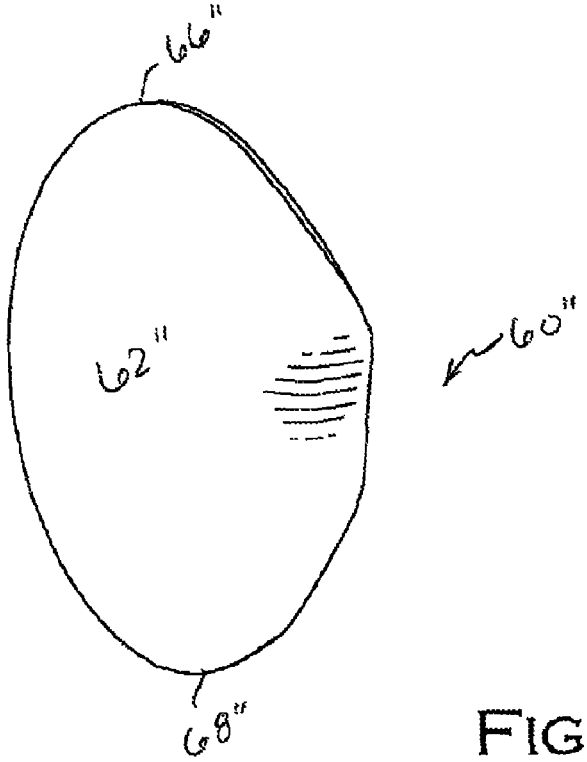
FIG. 26 is a front perspective view of an embodiment of an ambidextrous finger shield to be worn over fingers of a user according to the present invention.
Figure 27:
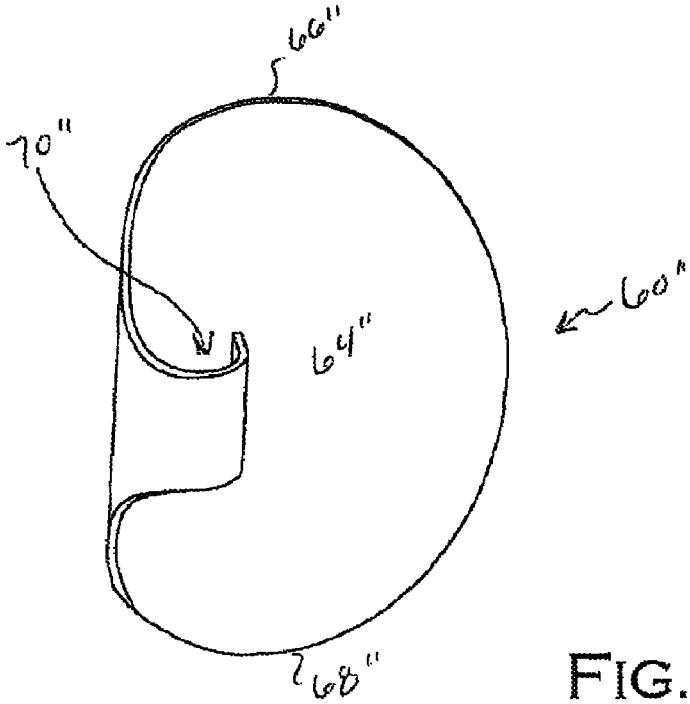
FIG. 27 is a rear perspective view of the ambidextrous finger shield illustrated in FIG. 26.

Referring now additionally to FIGS. 26 and 27, still another embodiment of the finger shield 60" according to the present invention is now described in greater detail. In this embodiment of the finger shield 60", similar to the embodiment of the finger shield 60' illustrated in FIGS. 24 and 25, an outer peripheral side portion of the finger shield is curved adjacent the finger engagement member 70". The peripheral side portion of the finger shield 60" opposite the curved side portion is also curved. The curved side portion of the finger shield 60" advantageously provides a smaller and simpler to use finger shield. The remaining elements of this embodiment of the finger shield 60" are similar to those of the first embodiment of the finger shield 60, are labeled with double prime notation, and require no further discussion herein.

Figure 28:
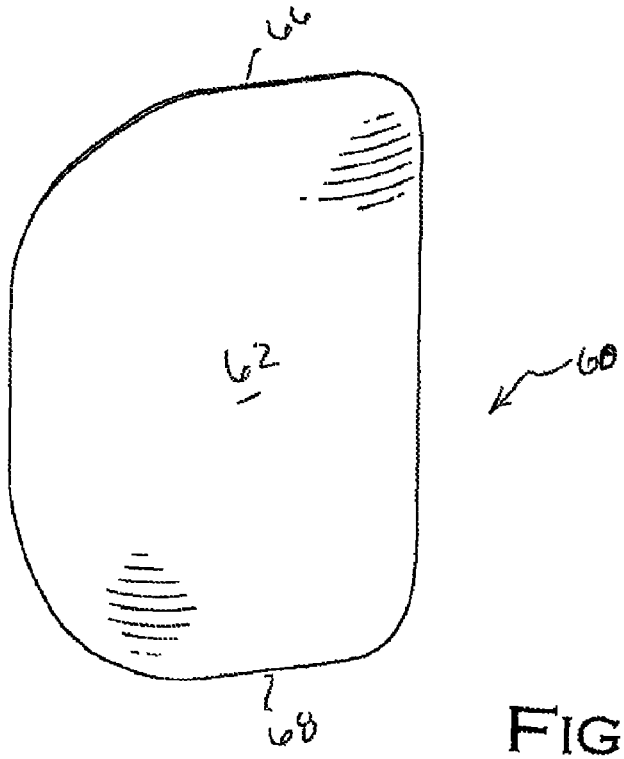
FIG. 28 is a front perspective view of an ambidextrous finger shield according to the present invention including a coating positioned adjacent a rear portion thereof.
Figure 29:
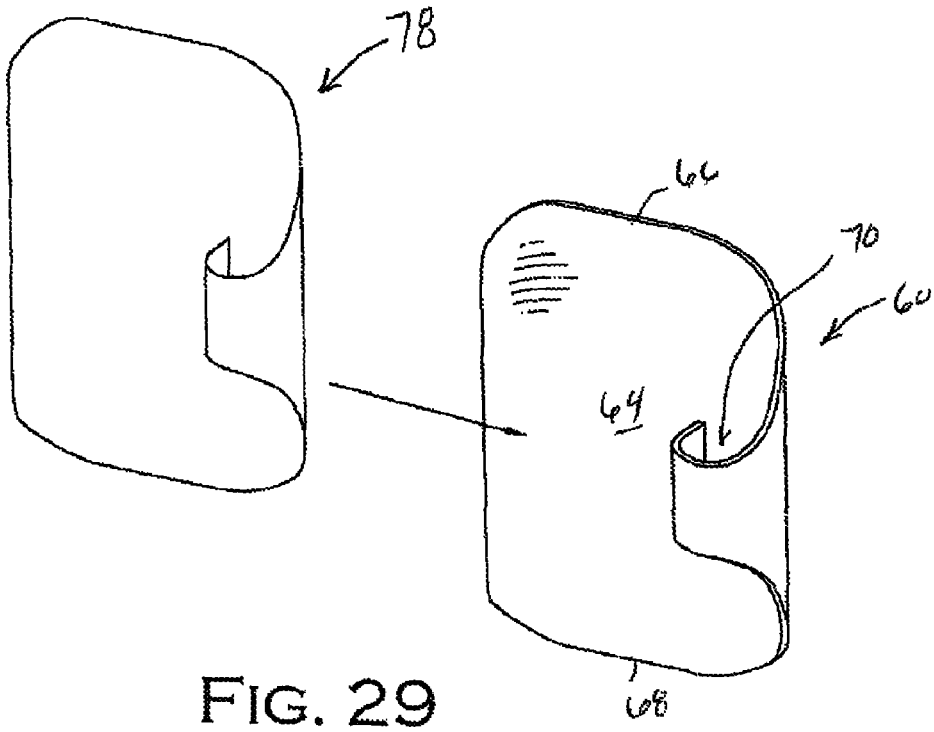
FIG. 29 is a rear perspective view of the ambidextrous finger shield illustrated in FIG. 28.

Referring now additionally to FIGS. 28 and 29, another feature of the finger shield 60 according to the present invention is now described in greater detail. As perhaps best illustrated in FIG. 29, the finger shield 60 may include a coating 78 that may be applied to the rear 64 of the finger shield. The coating 78 is preferably a slip resistant material that may be applied to the rear 64 of the finger shield 60. The slip resistant material may, for example, be a plastic type of material, or any other type of slip resistant material as understood by those skilled in the art. The coating 78 may be applied by being sprayed on, or by any other manner as understood by those skilled in the art. For example, the coating 78 may be a one piece coating that is applied to the rear 64 of the finger shield 60 using an adhesive. The slip resistant properties of the coating 78 advantageously enhance use of the finger shield 60 by providing increased stability during use.

The finger guard system 10 according to the present invention contemplates providing a kit that provides the finger guard 12, the thumb guard 40, and the finger shield 60 contained therein. Those skilled in the art will appreciate that the kit may include any number of finger guards 12, any number of thumb guards 40, and any number of finger shields 60 positioned therein. The kit may include a container, i.e., a box or bag, within which the finger guard 12, the thumb guard 40, and the finger shield 60 may be positioned. Further, the kit may include instructions for use. The finger guard system 10 according to the present invention also contemplates that the finger guard 12 and the thumb guard 40 may be simultaneously worn by a user. Similarly, the finger guard system 10 according to the present invention contemplates that the thumb guard 40 and the finger shield 60 may be simultaneously worn by the user. Accordingly, the kit of the present invention contemplates inclusion of any combination in any number of the finger guard 12, the thumb guard 40, and the finger shield 60.

Alternately, the user may choose to wear the finger guard 12, the thumb guard 40, or the finger shield 60 individually. Further, those skilled in the art will appreciate that any number of finger guards 12 may be worn by the user at any given time. The finger guard 12 and the thumb guard 40 are advantageously adapted to be worn on either the left hand or the right hand of the user. Similarly, the finger shield 60 is adapted to be worn on either the left hand or the right hand of the user. Accordingly, the finger guard 12 and the thumb guard 40 according to the present invention advantageously may be user by different users.

The finger guard 12, the thumb guard 40, and the finger shield 60 of the finger guard system 10 according to the present invention may advantageously be constructed by a semi-rigid material. For example, the finger guard 12, the thumb guard 40, and the finger shield 60 may be formed of a semi-rigid plastic material. This type of material provides for flexibility of the finger guard main body 14 and the thumb guard main body 42, and the finger engagement member 70 of the finger shield 60, as well as high strength properties. Those skilled in the art will appreciate that any material having substantially high strength properties and flexibility properties may be used to accomplish the goals, features and advantages according to the present invention.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A finger guard system comprising:

a finger guard adapted to be worn on a finger of a user, the finger guard comprising a substantially tubular finger guard main body having a top, a bottom, an upper portion, a lower portion opposite the upper portion, and a medial portion between the upper portion and the lower portion, the medial portion including a bend so that the upper portion is angled with respect to the lower portion, and a longitudinal slit formed through the bottom of finger guard main body and extending from the upper portion of the finger guard main body to the lower portion of the finger guard main body, wherein the upper portion includes an angled edge, wherein the lower portion includes an angled edge, a thumb guard adapted to be worn on a thumb of a user, the thumb guard comprising a substantially tubular thumb guard main body having a top, a bottom, an upper portion, a lower portion opposite the upper portion, and a medial portion, the medial portion including a bend so that the upper portion is angled with respect to the lower portion, a longitudinal slit formed through the thumb guard main body on the bottom and extending the entire length of the bottom of the thumb guard main body.

2. A finger guard system according to claim 1 wherein the lower portion of the finger guard main body is adapted to be positioned adjacent a tip of the user's finger when worn by the user.

3. A finger guard system according to claim 1 wherein the bottom of the finger guard main body extends between the angled edge of the upper portion of the finger guard main body to the angled edge of the lower portion of the finger guard main body.

4. A finger guard system according to claim 1 wherein the bottom of the thumb guard main body is adapted to be positioned adjacent a tip of the user's thumb when worn by the user.

5. A finger guard system according to claim 1 wherein the bottom of the thumb guard main body extends between an edge of the upper portion of the thumb guard main body to the medial portion of the thumb guard main body.

6. A finger guard system according to claim 1 wherein the bottom of the thumb guard main body has an open tubular shape extending from the upper portion of the thumb guard main body to the medial portion of the thumb guard main body.

7. A finger guard system according to claim 1 wherein the thumb guard and the finger guard are adapted to be worn by the user simultaneously.

8. A finger guard system according to claim 1 wherein the finger guard is adapted to be positioned over any finger of the user excluding the user's thumb.

9. A finger guard system according to claim 1 wherein each of the finger guard and the thumb guard are made of a semi-rigid material.

10. A finger guard system according to claim 1 further comprising a finger shield adapted to be worn on a finger of a user, wherein the finger shield comprises:

a front, a rear, a top, a bottom, and a finger engagement member having a main body portion and a side portion, the finger engagement member connected to the rear adjacent a medial portion thereof, wherein the front, the rear, the top, the bottom and the finger engagement member are integrally formed as a monolithic unit.

11. A finger guard system according to claim 10 wherein the finger shield includes a side portion and wherein the finger engagement member includes a side portion; and wherein the side portion of the finger shield and the side portion of the finger engagement member meet to form a pocket.

12. A finger guard system according to claim 10 wherein the main body portion of the finger engagement member is curved to engage the finger of a user.

13. A finger guard system according to claim 10 wherein the front of the finger shield is a curved front, and wherein outer peripheral edge portions of the front are curved.

14. A finger guard system according to claim 10 wherein a side portion of the front and rear of the finger shield opposite the finger engagement member is provided by a substantially straight edge.

15. A finger guard system according to claim 10 wherein a side portion of the front and rear of the finger shield opposite the finger engagement member is provided by an edge having an arcuate shape.

16. A finger guard system according to claim 10 wherein the finger shield further comprises a coating to be carried by the rear.

17. A finger guard adapted to be worn on a finger of a user and comprising:

a substantially tubular finger guard main body having a top, a bottom, an upper portion, a lower portion opposite the upper portion, and a medial portion between the upper portion and the lower portion, the medial portion including a bend so that the upper portion is angled with respect to the lower portion; and a longitudinal slit formed through the finger guard main body on the bottom and extending from the upper portion of the finger guard main body to the lower portion of the finger guard main body;

wherein the upper portion includes an angled edge;

wherein the lower portion includes an angled edge.

18. A finger guard according to claim 17 wherein the lower portion of the finger guard main body is adapted to be positioned adjacent a tip of the user's finger when worn by the user.

19. A finger guard according to claim 17 wherein the bottom of the finger guard main body extends between the angled edge of the upper portion of the finger guard main body to the angled edge of the lower portion of the finger guard main body.

* * * * *